United States Patent [19]

Schmidt

[11] Patent Number: 5,074,732

[45] Date of Patent: Dec. 24, 1991

[54] METHOD OF PRODUCING A CAN END FROM METAL

[75] Inventor: Gunter H. R. Schmidt, Neuwied, Fed. Rep. of Germany

[73] Assignee: The Broken Hill Proprietary Company Limited, Melbourne, Australia

[21] Appl. No.: 511,908

[22] Filed: Apr. 24, 1990

Related U.S. Application Data

[63] Continuation of Ser. No. 338,510, Apr. 14, 1989, abandoned, which is a continuation of Ser. No. 121,637, Nov. 16, 1987, abandoned.

[30] Foreign Application Priority Data

Nov. 17, 1986 [DE] Fed. Rep. of Germany ..... 3639428

[51] Int. Cl.[5] ..... B21D 22/00

[52] U.S. Cl. ..... 413/15; 413/18

[58] Field of Search ..... 413/12, 13, 15-17, 413/18, 67, 68

[56] References Cited

U.S. PATENT DOCUMENTS 3,948,415 4/1976 Debenham .

3,980,034 9/1976 Pebenham et al. ..... 413/18

4,033,275 7/1977 Radtke ..... 413/15

OTHER PUBLICATIONS

American Heritage Dictionary, 2nd College Ed., 1982, Definition of "Lacquer".

*Primary Examiner*—James G. Smith

*Assistant Examiner*—Jack Lavinder

*Attorney, Agent, or Firm*—Armstrong, Nikaido, Marmelstein, Kubovcik & Murray

[57] ABSTRACT

A method is described for producing a can end from metal with at least one opening tab to be pushed in towards the inside portion of the can end. The method of this invention comprises the steps of forming a bulge which is directed upwards, partial punching of the opening tab for leaving a hinged area, displacing of the opening tab in relation to the edge area of the aperture towards the inside of the can end, final reforming of the edge area of the aperture and/or opening tab into a final form, and, if applicable, also coining the edge area of the opening tab so that the edge area of the aperture covers the edge area of the outside of the can end in the form of a ring. During the complete reforming and, if applicable, the coining operation, the two edge areas are held at a mutual axial distance from each other.

14 Claims, 3 Drawing Sheets

METHOD OF PRODUCING A CAN END FROM METAL

This application is a continuation of application Ser. No. 338,510 filed Apr. 14, 1989, which is a continuation of application Ser. No. 121,637 filed Nov. 16, 1987 now abandoned.

The invention relates to a method of producing a can end from metal with at least one opening tab that can be pushed in towards the end inside, comprising the following steps:

Forming of a bulge directed upwards,

Partial punching of the opening tab leaving a hinge area,

Displacing of the opening tab in relation to the edge area of the aperture towards the end inside, Final reforming of the edge area of aperture and/or opening tab into the final form, If applicable, also coining of the edge area of the opening tab so that the edge area of the aperture overlaps the edge area of the opening tab in the form of a ring.

In a known method of this kind (DE-OS 27 07 064), the height of the opening tab is reduced during reforming by reforming tools acting from above and below on said tab. Hereby, the diameter of the opening tab shall be increased. At least during the last phase of the reforming operation, the edge area of the opening tab and the edge area of the aperture surrounding the opening tab from the end inside will be pressed together by a lower reforming tool, whereas, from above, an annular holder or a reforming tool will press on the edge area of the aperture. Hereby, the mutually facing edge areas of opening tab and aperture will be pressed together in the axial direction, whereas, simultaneously, the reforming tools will effect an increase of the diameter of the opening tab. With this diameter increase, the edge area of the opening tab is pressed radially towards the outside at all points so that a relative displacement of the edge areas of aperture and opening tab in their common level of contact takes place. It has now been found that this relative displacement under simultaneous contact of the edge areas results in damage of the lacquer coating provided on the end inside and, if applicable, also on the end outside. The damage will be increased by the fact that, in punching the opening tab, a substantially radially extending burr will be produced at the edge of said tab and also at the edge of the aperture, with this burr, in pressing the edge areas together, penetrating into the lacquer coating lying opposite and acting similar to a draw knife during the relative displacement of the edge areas. As a last phase of reforming the opening tab, the known method is concluded by coining the edge area of the opening tab, whereby the diameter of the opening tab shall be additionally increased. This coining operation will also cause a relative displacement of the contacting edge areas and, so, even aggravate the damage to the lacquer coating. By damaging the lacquer coating, corrosion of the metal may occur, which will be a disadvantage, especially with tinned steel sheet (tinplate) or chromium coated steel sheet. If the edge areas of the opening tab and of the aperture contact each other during reforming and, if applicable, coining, this will bring another disadvantage by the lacquer coating pushed together into a wall by the burrs each existing on the edges of aperture and tab. In the subsequent application of plastisol which, as a sealing and corrosion protection of the cutting edges, is applied to the edge areas of aperture and opening tab from the end inside, this wall is a disadvantage, i.e. on the one hand, the wall prevents the penetration of plastisol between the edge areas and, on the other hand, air inclusions may occur in the plastisol, because, actually, the wall will prevent the air escaping to the end outside during application of the plastisol. The air inclusions in the plastisol will affect its sealing effect.

In another known method (DE-PS 21 46 452), the height of the edge area of the aperture is reduced by reforming tools in order to produce the overlap of the edge areas of aperture and opening tab resulting in a reduction of the aperture. Here, too, a relative displacement of the edge areas of aperture and opening tab takes place and, here too, lacquer damage may occur. Besides, as the burr on the edge of the aperture and of the opening tab respectively is often not evenly formed around the total circumference, it may happen that the burr penetrating the contacting edge area may prevent a further relative displacement of the two edge areas at this point, resulting in an increased relative displacement take place at the diametrically opposed edge areas. In relation to the aperture, the opening tab will then be tilted, and no uniform overlap of the edge areas of aperture and opening tab around the total circumference will be obtained.

Therefore, the invention is based on the task to improve the method of producing a can end from metal with at least one opening tab to be pushed in towards the end inside, as mentioned in the beginning, in so far as damage to the lacquer coating will be avoided and a most uniform possible overlap of the edge areas will be achieved.

According to the invention, this task is solved by holding the two edge areas of aperture and opening tab in a mutual axial distance during the complete final reforming and, if applicable, coining operation so that there will be a gap between the side of the edge area of the aperture facing the inside and the side of the edge area of the opening tab facing the outside.

By this measure, during reforming and coining respectively, mutual contact of the edge areas of aperture and opening tab will be avoided and so also damage to the lacquer. At the same time, the edge areas can be displaced in relation to each other without any hindrance so that tilting of the opening tab in relation to the aperture will be prevented and an almost uniform overlap of the edge areas around the total circumference of opening tab and aperture is ensured.

Advantageous steps for carrying out the method according to the invention are characterized in the sub-claims.

The invention is explained in more detail in the following by way of example as shown in the drawing, in which.

Figure 1:
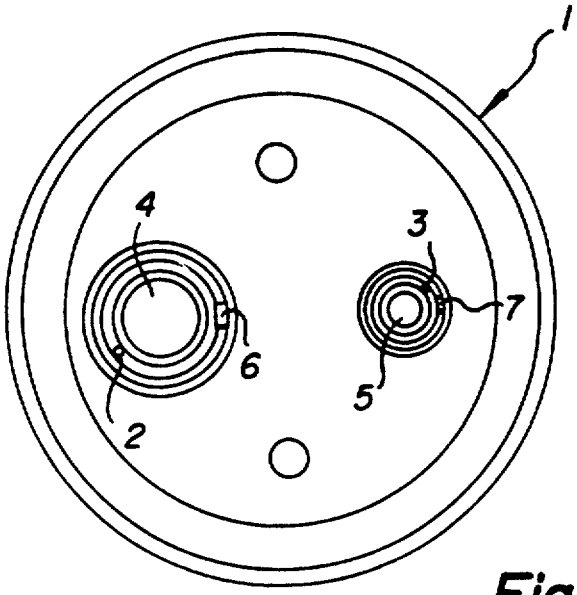
FIG. 1 is a general view of the can end.
Figure 2:
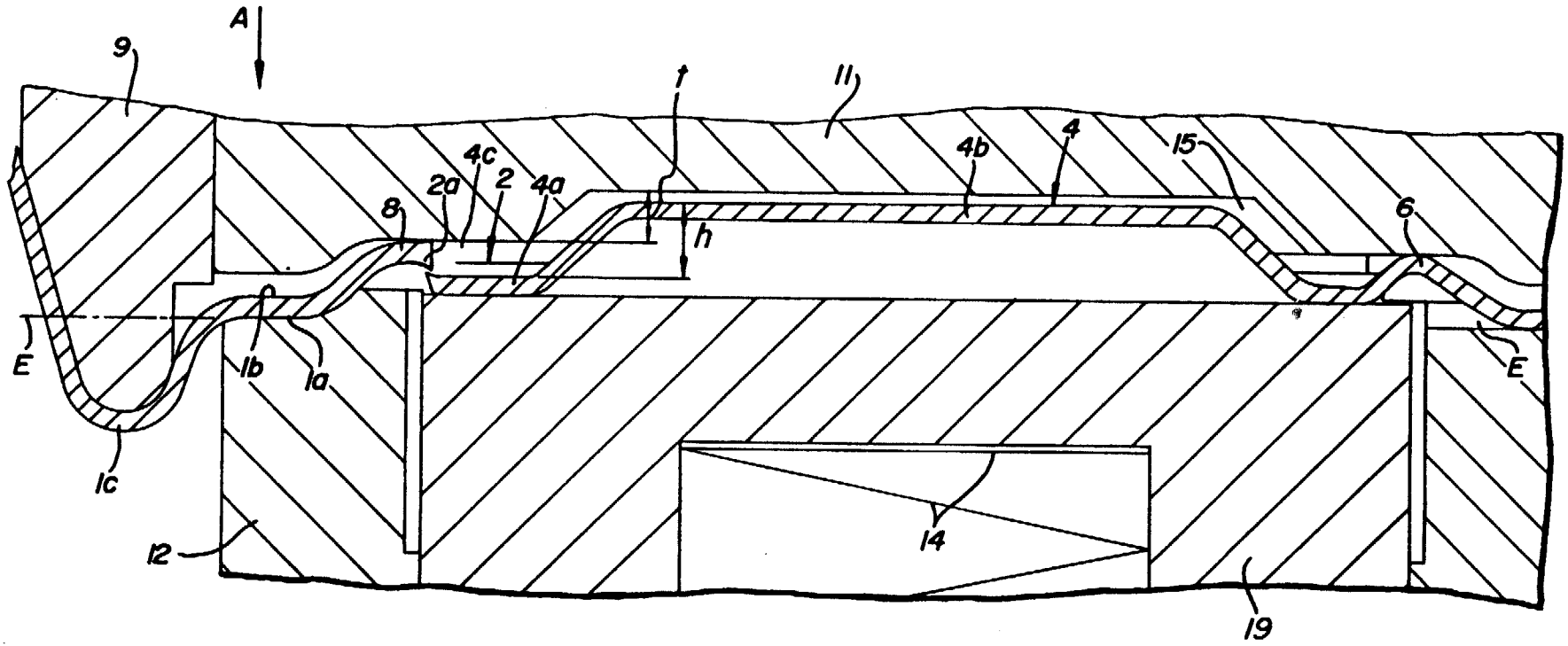
FIG. 2 is a partial cross-section of the can end in the area of the larger opening tab with the reforming tools at the beginning of the reforming operation.

The can end 1 presented in FIG. 1 consists of metal, preferably of steel sheet which has been usefully tin or chromium coated. This steel sheet has been provided with a lacquer coating, not shown in more detail, on the end inside 1*a* and also on the end outside 1*b*. These lacquer coatings are already applied to the metal to be used in the production of the can end. The end has two apertures of different diameters, the larger aperture 2 serving as the pouring aperture and the aperture with the smaller diameter serving as venting aperture 3. Each of the two apertures 2, 3 is normally closed by an opening tab 4, 5. The opening tabs 4, 5 are formed from the actual end 1. To this purpose, a bulge directed upwards is first formed by cold forming to form each opening tab 4, 5, as described in DE-OS 27 60 389 or DE-PS 21 46 452. This bulge is partially punched so that a hinge area 6, 7 remains by which the relative opening tab 4, 5 is connected to the remaining end 1. In punching the opening tabs 4, 5, or immediately following to it, the relative opening tab opposite the matching aperture 2, 3 is pushed in towards the end inside 1*a* (according to the drawing towards below). Then, the edge area 4*a* of opening tab 4 will be—as shown in FIG. 2—below edge area 8 of aperture 2. This applies similarly to the edge areas of the small opening tab 5 and of the small aperture 3, so that is why the description below can, in its meaning, also be applied hereto, and a separate presentation in the drawing has been dispensed with.

In order to achieve the desired overlap of edge areas 4*a*, 8, either the height of opening tab 4 can be reduced by reforming tools hereby increasing the diameter of its edge area 4*a*, or edge area 8 of aperture 2 can be partially pushed downwards, thus reducing the diameter of edge area 8. The procedure described last will be explained below. If desired, both methods could also be used in a combination.

For producing the overlap of edge areas 4*a*, 8 of opening tab 4 and aperture 2, the reforming tools shown in FIG. 2 are provided. The upper tool 11 is positioned displaceable into direction A in the centering ring 9 which meshes with the end edge 1*c*. The lower tool 12 holds the ejector 13 against the force of a spring 14 displaceable towards below. The upper tool 11 has a recess 15, whose diameter is larger than the center part 4*b* in the form of a truncated cone of opening tab 4. Depth t of recess 15 is smaller in the axial direction by about 0.05–0.1 mm than the height h of the truncated-cone part 4*b*. Since, in the example shown, the opening tabs 4, 5 and the matching apertures 2, 3 are formed as circles, axial direction is defined herein as the direction which is perpendicular to the end plane E-E as shown, for example, in FIG. 2.

At the beginning of the reforming operation, the reforming tools 11–13 are positioned as shown in FIG. 2. If the upper tool 11 moves downwards, only edge area 8 of aperture 2 will first be pushed towards below. After a short stroke, also recess 15 will then settle axially against the truncated-cone part 4*b* of opening tab 4 and will also push towards below the opening tab which, with its edge area 4*a*, is supported against ejector 13. Ejector 13 will then evade from the force of spring 14. At the end of the reforming operation, the reforming tools 11–13 will take the position shown in FIG. 3. Since depth t of recess 15 is slightly smaller than height h of the truncated-cone part 4*b*, edge areas 4*a* and 8 of opening tab 4 and aperture 2 will be held at a distance from each other during the complete reforming operation. In the final position of the reforming tools shown in FIG. 3, this distance also exists in the form of a gap S between the inwardly facing side 8' of edge area 8 of aperture 2 and the outwardly facing side 4'*a* of opening tab 4. The size of gap S corresponds to the difference between height h of the truncated-cone part 4*b* and depth t of recess 15 as shown in FIG. 3, minus the height of the edge area 8.

The edge areas 4*a* and 8 are also held at a distance by the reforming tools 11–13.

The size of this distance or gap S depends on the height of the burr in the axial direction on edge 2*a* of aperture 2 and edge 4*c* of opening tab 4 respectively resulting from punching the opening tab 4. The distance or gap S must always be slightly larger than the maximum height of the expected burr. By this means, the burr protruding to the outside (upwards) from the outwardly (upwards) facing side 4'*a* at edge 4*c* of opening tab 4 will, for example, be prevented from penetrating into the lacquer coating provided on the end inside 1*b*. Inversely, a burr protruding to the inside (downwards) from the inwardly (downwards) facing side 8' at edge 2*a* will penetrate into the lacquer coating provided on the end outside 1*b*. Based on comprehensive tests, it has been that it is sufficient to hold the edge areas 4*a* and 8 during the final reforming and coining respectively described below at an axial distance of about 0.05–0.1 mm.

Figure 3:
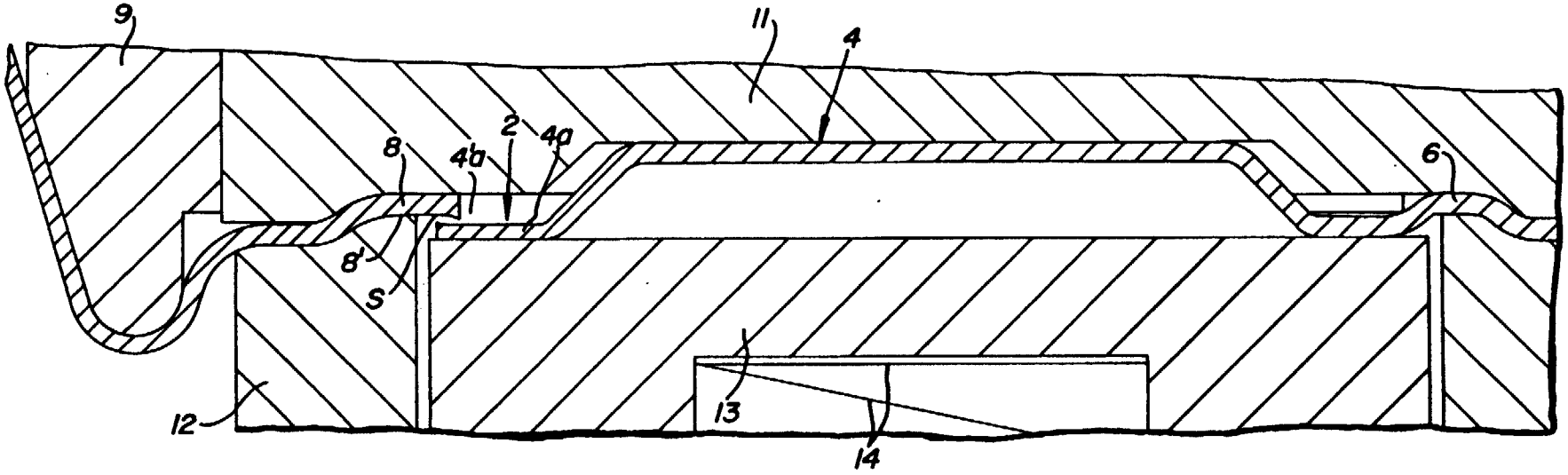
FIG. 3 is a similar partial cross-section at the end of the reforming operation.

By pushing downwards edge area 8 of aperture 2, its diameter will be reduced so that, at the end of the reforming operation, according to FIG. 3, edge areas 4*a* and 8 will overlap and edge area 8 of aperture 2 will cover edge area 4*a* of opening tab 4 from outside. In order to even increase this covering in the radial direction, it is known to reduce the thickness of edge area 4*a* of opening tab 4 by means of coining tools. Due to this thickness reduction, the material of edge area 4*a* will flow radially to the outside, hereby increasing the diameter of the edge area.

Figure 4:
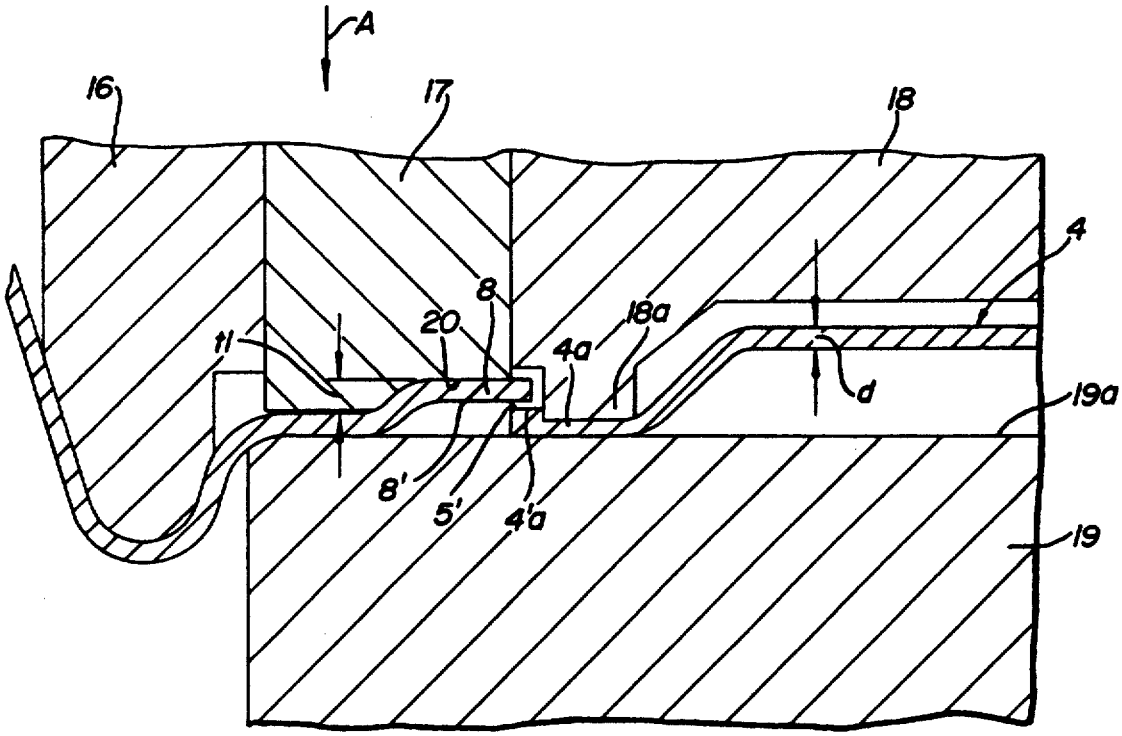
FIG. 4 is a similar partial cross-section during the coining operation.

In this coining operation too, as shown in FIG. 4, a relative displacement of edge areas 4*a* and 8 in the radial direction will occur. Therefore, also during the coining operation, the mutually facing sides 4'*a* and 8' of edge areas 4*a* and 8 must be held at a mutual axial distance corresponding to the width of gap S. To this purpose, the coining tools shown in FIG. 4 have been designed accordingly. The holder 17 is positioned displaceable in direction A in the centering ring 16. In turn, coining punch 18 in holder 17 is displaceable in the same direction. A stationary anvil 19, with its face 19*a* serving to support the inside 1*a* of the end and also the edge area 4*a* of opening tab 4, serves as a counter-holder. Holder 17 has a recess 20 for edge area 8, with depth t1 of this recess corresponding to the metal thickness d of end 1 plus the size of gap S which, between edge areas 4*a* and 8, shall exist also during the coining operation ($t1 = d + S$). In coining, too, the distance between the edge areas shall be greater than the expected maximum height of the burr. The coining punch 18 has an annular protrusion 18*a* at its lower end pressing on an annular area of edge area 4*a* and so pressing the edge area on to a face 19*a* of anvil 19. Hereby, the metal thickness of edge area 4*a* in the area of protrusion 18*a* will be reduced, and the displaced metal will cause an increase of the diameter of edge area 4*a*.

In order to be able to minimize the distance between edge areas 4*a* and 8 during reforming and coining, it is appropriate to use punching tools for punching opening tab 4*a* with a clearance amounting to about 5% of the metal thickness of the can end. This will, in the axial direction, minimize the burrs occuring on the edge of the aperture and/or on the edge of the opening tab.

It has been described above that, also in coining the edge area of the opening tab, the edge areas of said tab and of the aperture shall be held at a distance. This will be the case if, by coining, an increase of the diameter of the opening tab shall be obtained. However, in some cases, a diameter increase will not be necessary, since the overlap of the edge areas of aperture and opening tab produced by reforming will already be sufficient. In such cases, a "mild" coining operation, with the coining tool penetrating into the metal of the edge area of the opening tab not at all or only to a very little degree, will be used to press flat the edge area of the opening tab. In such cases, no diameter increase of the opening tab occurs and, so, also no relative displacement of the edge areas of aperture and opening tab is to be expected. Therefore, in a "mild" coining operation of this kind, holding the edge areas at a distance during the coining operation can be dispensed with.

While the invention has been particularly shown and described in reference to preferred embodiments thereof, it will be understood by those skilled in the art that changes in form and details may be made therein without departing from the spirit and scope of the invention.

I claim:

1. A method of preventing burr damage to a lacquer coating on the inside surface of a can end having a push in easy open closure formed therein, wherein the push in easy open closure is formed by the steps of forming an upwardly directed bulge in the metal; partially severing the metal proximate the bulge to define a can aperture and tab therefor while leaving an unsevered hinge area for connecting the tab to the remainder of the can end, displacing the tab toward the can end inside relative to the edge of the can aperture; thereafter displacing at least one of the edge areas of the can end surrounding the aperture and the opening tab to cause the edge area of the can aperture surround to overlap the edge area of the opening tab; and sealing the area of severance, said method comprising maintaining the edge area of the opening tab and the edge area of the can aperture at a distance from each other to define a gap therebetween of at least 0.05 mm during and after the edge area displacing step to prevent penetration of said lacquer coating by burrs located on the edge area of the opening tab and/or the can aperture surround.

2. The method of claim 1, wherein the edge areas are held apart by displacement tools.

3. The method of claim 2, wherein the displacement tool are reforming and coining tools.

4. The method of claim 1, wherein said edge areas are held apart an axial distance of between 0.05 mm and 0.1 mm.

5. The method of claim 1, wherein the metal is partially severed by punching the opening tab with a punching tool having a cutting clearance of about 5% of the can end metal thickness.

6. The method of claim 1, wherein the displacement is achieved by reforming and coining at least one of the edge areas, and the gap is maintained during the reforming step and the coining step.

7. The method of claim 6, wherein the edge area of the opening tab is displaced.

8. In a method for producing at least one opening tab in a metal can end having an inside surface with a lacquer coating thereon, wherein the can end is opened by displacement of the opening tab towards a can end inside, said method comprising:

forming an upwardly directed bulge in the metal;

partially severing an opening tab in the metal proximate said bulge to define a can aperture while leaving an unsevered hinge area for connecting the opening tab to the remainder of the can end;

displacing the opening tab towards the can end inside relative to an edge of the can aperture; and displacing at least one of the edge areas of the can aperture and the opening tab to cause the edge area of the can aperture surround to overlap the edge area of the opening tab, the improvement comprising preventing burr damage to the lacquer coating on the can end inside surface by maintaining the edge areas of the can aperture and the opening tab at a distance from each other to define a gap therebetween which is larger than a burr produced on the edge area of the opening tab or the can aperture by the partial severing step to avoid contact of metal with the inside surface of the lacquer coating during and after the edge area displacing step.

9. The method of claim 8, wherein the edge areas are held apart by displacement tools.

10. The method of claim 8, wherein the displacement tool are reforming and coining tools.

11. The method of claim 8, wherein said edge areas are held apart an axial distance of between 0.05 mm and 0.1 mm.

12. The method of claim 8, wherein the metal is partially severed by punching the opening tab with a punching tool having a cutting clearance of about 5% of the can end metal thickness.

13. The method of claim 8, wherein the displacement is achieved by reforming and coining at least one of the edge areas, and the gap is maintained during the reforming step and the coining step.

14. The method of claim 8, wherein the edge area of the opening tab is displaced.

* * * * *